United States Patent [19]

Stanek et al.

[11] Patent Number: 5,061,405

[45] Date of Patent: Oct. 29, 1991

[54] CONSTANT HUMIDITY EVAPORATIVE WICKING FILTER HUMIDIFIER

[75] Inventors: Terrence L. Stanek, St. Louis; Ronald G. Brant, Franklin County, both of Mo.; Donald L. Townsend, Maricopa County, Ariz.

[73] Assignee: Emerson Electric Co., St. Louis, Mo.

[21] Appl. No.: 478,423

[22] Filed: Feb. 12, 1990

[51] Int. Cl.[5] ..... B01F 3/04

[52] U.S. Cl. ..... 261/26; 261/104; 261/66; 261/72.1

[58] Field of Search ..... 261/104, DIG. 48, 26, 261/66, 72.1

[56] References Cited

U.S. PATENT DOCUMENTS

| | | | |
|---|---|---|---|
| 1,367,701 | 2/1921 | Haynes | 261/104 |
| 1,625,663 | 4/1927 | Kelly | 261/104 |
| 2,031,055 | 2/1936 | McKinney | 261/107 |
| 2,085,390 | 6/1937 | Quinlivan | 261/104 |
| 2,369,623 | 2/1945 | Utley et al. | 219/38 |
| 2,379,034 | 6/1945 | Pargman | 21/119 |
| 2,443,417 | 6/1948 | Duncan | 219/38 |
| 2,749,725 | 6/1956 | Essman et al. | 261/104 |
| 2,828,953 | 4/1958 | Hartmann | 261/104 |
| 3,045,450 | 7/1962 | Chandler | 261/104 |
| 3,074,698 | 1/1963 | Sevald | 261/35 |
| 3,188,007 | 6/1965 | Myklebust | 239/215 |
| 3,220,707 | 11/1965 | Weatherston et al. | 261/22 |
| 3,266,481 | 8/1966 | Wentling et al. | 126/113 |
| 3,283,478 | 11/1966 | Katzman et al. | 55/230 |
| 3,290,021 | 12/1966 | Blachly et al. | 261/29 |
| 3,323,784 | 6/1967 | Fazio | 261/130 |
| 3,348,822 | 10/1967 | Vieceli et al. | 261/34 |
| 3,376,025 | 4/1968 | Flury | 261/29 |
| 3,598,370 | 8/1971 | Hoag | 261/26 |
| 3,852,380 | 12/1974 | Wiseman | 261/27 |
| 3,864,437 | 2/1975 | Blaszkowski | 261/24 |
| 3,914,349 | 10/1975 | Stipanuk | 261/29 |
| 4,117,045 | 9/1978 | Henke et al. | 261/30 |
| 4,252,547 | 2/1981 | Johnson | 261/104 |
| 4,362,090 | 12/1982 | Whiteley | 98/33 |
| 4,540,529 | 9/1985 | Koszyk | 261/91 |
| 4,624,806 | 11/1986 | Koszyk | 261/91 |
| 4,699,737 | 10/1987 | Engstrand | 261/24 |
| 4,719,057 | 1/1988 | Mizoguchi | 261/DIG. 48 |
| 4,810,854 | 3/1989 | Jursich et al. | 219/276 |
| 4,822,533 | 4/1989 | Steiner et al. | 261/72.1 |
| 4,853,161 | 8/1989 | Huang | 261/DIG. 48 |
| 4,865,775 | 9/1989 | Steiner et al. | 261/24 |
| 4,921,639 | 5/1990 | Chiu | 261/DIG. 48 |

FOREIGN PATENT DOCUMENTS

| | | | |
|---|---|---|---|
| 2604169 | 8/1977 | Fed. Rep. of Germany | 261/107 |
| 1261072 | 4/1961 | France | 261/107 |

*Primary Examiner*—Tim Miles

*Attorney, Agent, or Firm*—Polster, Polster and Lucchesi

[57] ABSTRACT

A constant humidity evaporative wicking filter humidifier is disclosed as having a water reservoir tank for holding a supply of water. The water reservoir tank is mounted on a supporting base and is constructed to dispense water as needed into a catch basin formed in the supporting base. A wick element of predetermined height has its lower end positioned within the catch basin for absorbing water up into the wick element by capillary action. A motor driven fan is also mounted on the supporting base relative to the wick element for drawing air with increased humidity through the wick element for discharge from the humidifier into the surrounding atmosphere. The water reservoir tank includes a valve which is selectively responsive to the level of water in the catch basin for dispensing water from the water reservoir tank into the catch basin when the water in the catch basin is below a predetermined level. The fan is driven by a motor that is mounted within a one-piece injection molded motor frame having quick interconnect locking elements for assembly of the motor frame to the supporting base and for quick assembly of other electrical components to the motor frame.

21 Claims, 8 Drawing Sheets

CONSTANT HUMIDITY EVAPORATIVE WICKING FILTER HUMIDIFIER

BACKGROUND OF THE INVENTION

The present invention relates to constant humidity evaporative wicking filter humidifier, and more specifically, to a humidifier of the type which is designed to satisfy home humidity requirements through the principle of evaporation of water into the air.

During the winter season, heated rooms normally tend to have low moisture conditions as a result of being filled with heated outside air. Low relative humidity causes many problems including discomfort to the occupants of the rooms, drying out of furniture and plants, excessive static electricity, and numerous problems. To overcome these problems, humidifiers are typically used to increase humidity levels within heated rooms during the winter heating season.

There are many different types and varieties of humidifiers that have been developed including centrifugal pump/evaporative filter humidifiers; air blown wicking/evaporative element humidifiers; motor driven belt pad humidifiers; wicking element humidifiers; and other types. The present invention is related to wicking element type humidifiers, but is principally constructed for use as a portable table top humidifier.

Several types of wicking element humidifiers are disclosed U.S. Pat. Nos. 4,822,533 and 4,865,775, which are assigned to the same assignee as the present invention. However, the wicking element humidifiers shown in these patents are principally, although not exclusively, used for floor mounted type humidifiers. The humidifier constructions shown in these patents disclose a humidifier which provides a constant evaporative area of a wicking element that is independently floatable on water within a reservoir tank, and which is part of a closed air flow path including a fixedly mounted fan, for discharging air with increased humidity from the humidifier. While constructions shown in these patents have worked quite well in floor-type models, they utilize more features and constructions than is necessary for portable table top humidifier constructions.

Other floor type humidifiers are known in which a wicking or evaporative element is at least in part submerged in a water bath and in which air is blown over the wetted wicking element so as to evaporate water therefrom. However, such immersed filter or wicking element humidifiers require a separate reservoir or water supply which feeds water to an evarporative sump by means of a float control valve in order to maintain a substantially constant water level wetting of the evaporative pad. Reference may be made to U.S. Pat. No. 2,031,055 for a more complete disclosure of such a humidifier.

Portable table top humidifiers have been disclosed in the prior art, such as in U.S. Pat. Nos. 3,188,007; 3,283,478; 3,290,021; and 4,699,737. In most cases, the portable table top humidifiers of the prior art have been principally used as vaporizers for users experiencing respiratory diseases. Unfortunately, most of the prior art portable table top humidifiers discharge relatively large water droplets or particles for inhalation by the person suffering from respiratory ailments. For vaporizers, the discharge of relatively large water droplets or particles does not present a problem; however, where it is desired to increase the humidity level throughout a particular room, the release of moist air in the form of vapor is desired, rather than water droplets or particles.

As a result, there is a recognized need for a portable table top humidifier which functions somewhat in the manner of the aforementioned floor-type models, but which is designed specifically for portable table top use, thus requiring a balancing of the construction, efficiency of operation and cost of such units. The construction of the constant humidity evaporative type wicking filter humidifier, as disclosed, can also be used for floor models, if desired.

SUMMARY OF THE INVENTION

Among the several objects and advantages of the present invention may be noted:

The provision of a humidifier which overcomes all of the previously known deficiencies of prior art humidifiers, while providing a substantially improved construction, for use in either portable table top or floor-type models, as disclosed in detail herein;

The provision of a humidifier which satisfies home humidity requirements through the principle of evaporation of water into the air, specifically the release of moist air in the form of vapor, rather than water droplets, into a home;

The provision of the aforementioned humidifier in which all evaporation into the air takes place in the humidifier, with all residue left by the evaporating water remaining in a wicking element or filter in the humidifier, so as to be kept from being passed into the home;

The provision of the aforementioned humidifier including a water reservoir tank that is removably mounted to a supporting base and is constructed to dispense water into a catch basin formed in the supporting base and in which a wicking element is disposed, the wicking element being positioned relative to a motor driven fan for drawing air with increased humidity through the wick element and for discharge from the humidifier into the surrounding atmosphere;

The provision of the aforementioned humidifier in which the water reservoir tank includes a removable fill cap to permit filling of the reservoir tank with water when removed from the supporting base, the water reservoir tank including valve means responsive to the level of water within the catch basin for dispensing water from the water reservoir tank into the catch basin when the water in the catch basin is below a predetermined level;

The provision of the aforementioned humidifier wherein the water reservoir tank is provided with a spring biased valve stem with included valve seat that engages a button activator within the catch basin to allow air to bleed into the water reservoir tank for discharging water therefrom until the water level reaches a predetermined level so as to cut off air flow into the water reservoir tank and stop the water discharged therefrom;

The provision of the aforementioned humidifier including a one-piece injection molded motor frame for supporting the motor to drive the fan, the motor frame further including quick interconnect locking means for assembly to the supporting base and for assembly of various electronic components for use in the motor circuit operating the fan; and The provision of the aforementioned humidifier which is simple to construct and easy to operate, is quiet and reliable in operation, includes a minimum number of moving parts, facilitates maintenance and replacement of a disposable wick element or filter, and is otherwise well adapted for the purposes intended.

Briefly stated, a humidifier of the present invention includes a water reservoir tank for holding a supply of water which is mounted on a supporting base. The water reservoir tank is constructed to dispense water as needed into a catch basin formed in the supporting base. A wick element of predetermined height is provided and has its lower end positioned within the catch basin for absorbing water up into the wick element by capillary action. The humidifier further includes a motor driven fan mounted on the supporting base relative to the wick element for drawing air with increased humidity through the wick element for discharge from the humidifier into the surrounding atmosphere.

The water reservoir tank includes valve means which are selectively responsive to the level of water within the catch basin for dispensing water from the water reservoir tank into the catch basin when the water in the catch basin is below a predetermined level. The valve means on the water reservoir tank is mounted on a lower end thereof for engaging a valve activator within the catch basin to dispense water from the water reservoir tank. Specifically, the valve means of the water reservoir tank includes a spring biased valve stem with included valve seat that engages a fixed button activator within the catch basin when the water reservoir tank is mounted on the supporting base, the spring biased valve stem disengaging the valve seat from the water reservoir tank to allow air to bleed into the water reservoir tank for discharging water therefrom until the water level in the catch basin reaches a predetermined level in the catch basin so as to cut off air flow into the water reservoir tank and stop the water discharged therefrom.

The humidifier includes a housing containing the wick element and motor driven fan, with air inflow openings provided in the housing along a rear face thereof and adjacent the wick element, and air discharge openings provided on a front face of the housing and adjacent the motor driven fan. The housing further includes a hinged cover along an upper face thereof and above the wick element to enable removal and replacement of the wick element as desired. The catch basin formed in the supporting base includes a U-shaped channel below the water reservoir tank which opens up into an enlarged receptacle below the wick element for containing water and for receiving the lower element of the wick element therein.

In addition to the valve means, including the spring biased valve stem with included valve seat, the water reservoir tank includes a removable fill cap for filling the water reservoir tank with water when removed from the supporting base.

For supporting the motor and fan, a one-piece injection molded motor frame is provided and includes first quick interconnect locking means for assembly of the motor frame to the supporting base as well as second quick interconnect means for assembly of electronic components including a rotary switch and humidistat to the motor frame.

The first quick interconnect locking means includes an elongated slot formed in the supporting base with a generally centrally positioned interlocking slot therein for complementary interlocking with supporting feet extending from the motor frame and receipt within the elongated slot on opposite sides of the interlocking slot, in order to support the motor frame relative to the supporting base. The motor frame further includes a complementary interlocking element for locking engagement within the interlocking slot to provide assembly of the motor frame to the supporting base.

The second quick interconnect means includes an overlying flexible panel having integral fastener studs depending therefrom for engagement within complementary openings formed in a rotary switch and humidistat.

These and other objects and advantages of the present invention will become apparent from the ensuing description.

BRIEF DESCRIPTION OF THE DRAWINGS

In the drawings.

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives and uses of the invention, including what we presently believe is the best mode of carrying out the invention.

Figure 7:
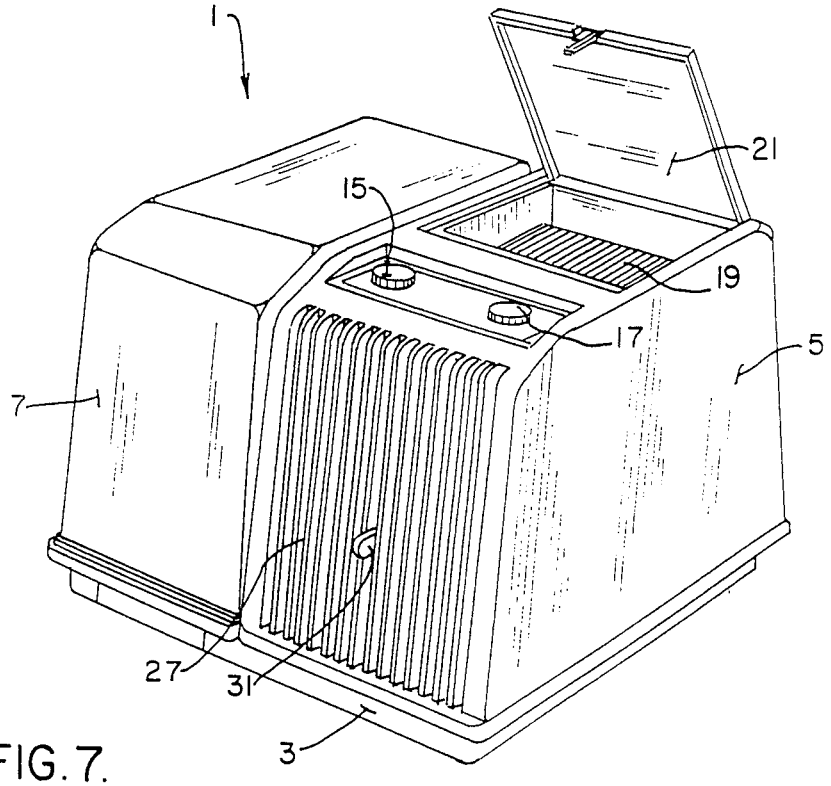
FIG. 7 is a perspective view illustrating the removable housing cover element for exposing the wicking element or filter.
Figure 8:
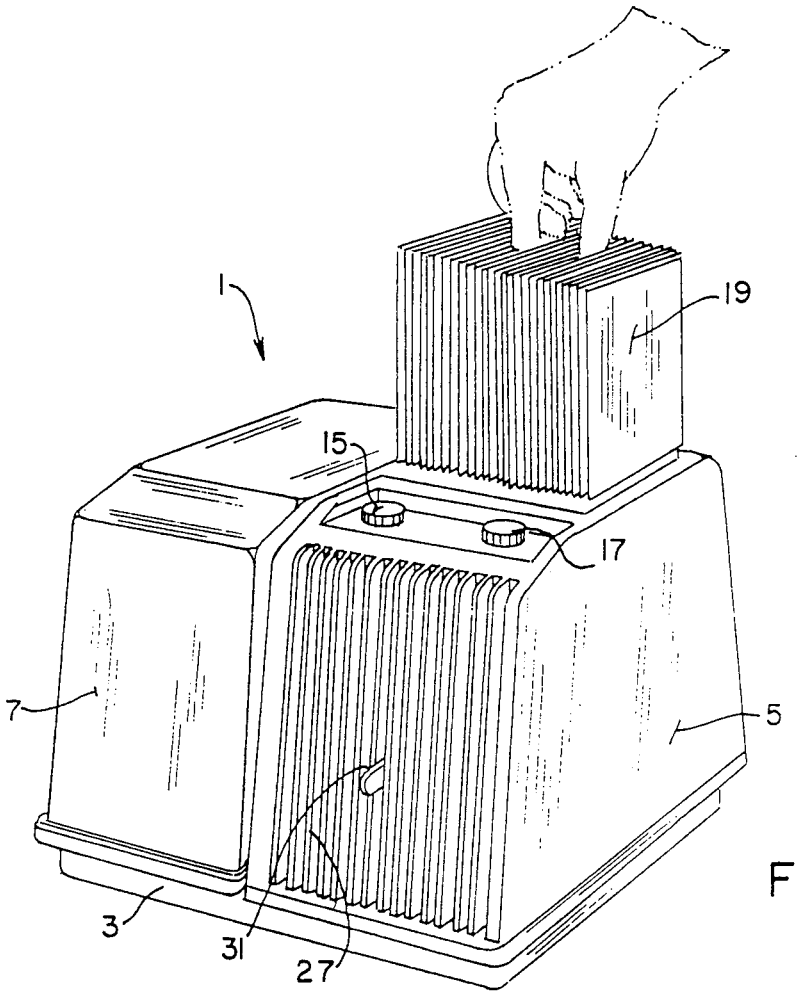
FIG. 8 is a perspective view of a portable table top humidifier illustrating the manner in which the wicking element or filter is removed or replaced relative to the humidifier.

Referring now to FIGS. 1–4 and 7–8, it will be seen that the portable table top humidifier 1 includes a supporting base 3 on which a housing 5 and a water reservoir tank 7 are mounted. Within the housing 5 and supported by the supporting base 3 is a fan motor assembly 9 including fan 11 and motor 13 which are energized by the operating air flow and humidity controls 15, 17 respectively, that will be subsequently discussed. Also contained within the housing 5 is a wicking element or filter 19 that is positioned between rear of the housing 5 and the fan/motor assembly 9, for purposes to be subsequently discussed. In order to remove and/or replace the wicking element or filter 19, the top of the housing 5 includes a hinged cover 21 along an upper face of the housing, enabling the wicking element or filter !9 to be first exposed, as shown in FIG. 7, and then removed from the portable table top humidifier 1, as shown in FIG. 8 of the drawings, for cleaning or replacement.

Along a rear face of the housing 5, there is provided a series of air flow openings 23 which are between adjacent pairs of the formed vertical and spaced struts 25 on housing 5. On the front face of the housing 5, there are also a series of vertical spaced struts 27 to provide a series of air discharge openings 29 therebetween along the front face of the housing 5.

Figure 4:
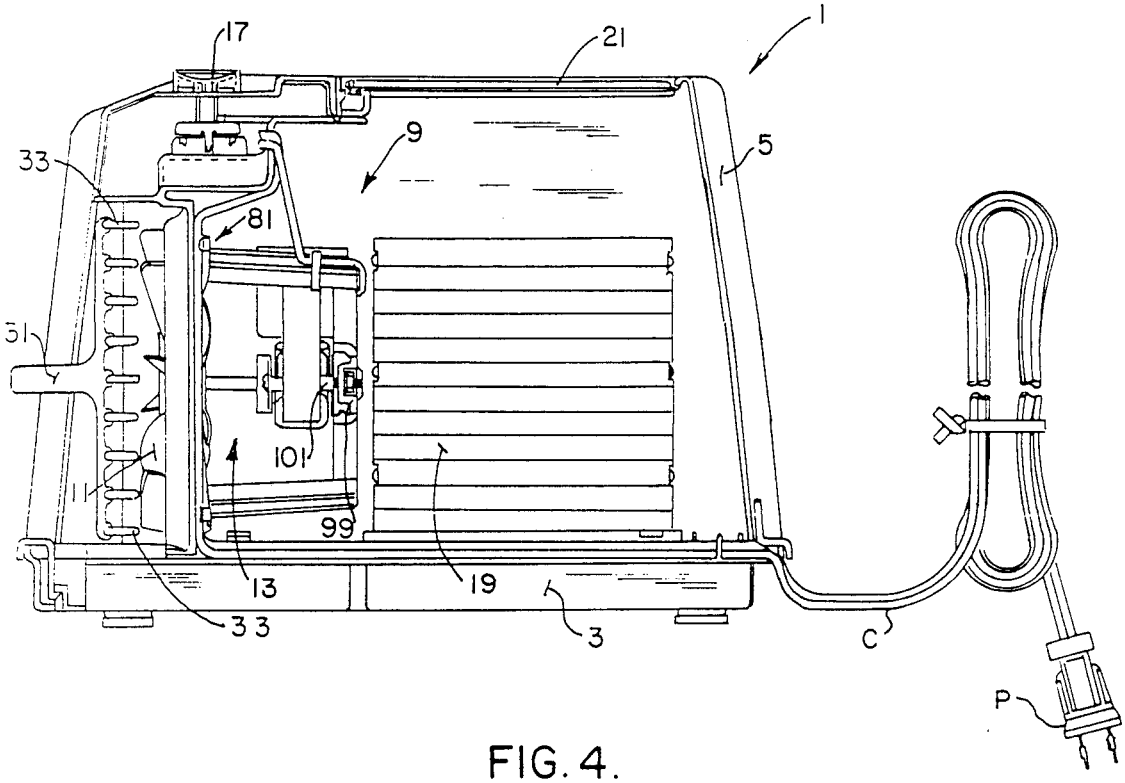
FIG. 4 is a fragmentary side elevational view of the portable table top humidifier revealing the interior thereof, including the wicking element and motor driven fan assembly.

Extending from a centrally located air discharge opening 29 along the front face of the housing 5 is a directional louver control lever 31 for controlling the direction of moistened air discharged from the portable table top humidifier 1. In FIG. 4 of the drawings, the directional louver control lever 31 is shown as being integrally attached to spaced horizontal louvers 33, through which moistened air may be first discharged and then through the air discharge openings 29. By moving the directional louver control lever 31 upwardly or downwardly as desired, the direction of the moistened air from the fan 11 through the air discharge openings 29 may be controlled.

The water reservoir tank 7 is constructed from a transparent plastic material for viewing the supply of water within the tank. The water reservoir tank 7 is removably mounted relative to the supporting base 3 as a result of the lower outer rim 35 thereof being received within the complementary configured flange 37 formed in the supporting base 3 in the area where the water reservoir tank 7 is adapted to be positioned.

Figure 5:
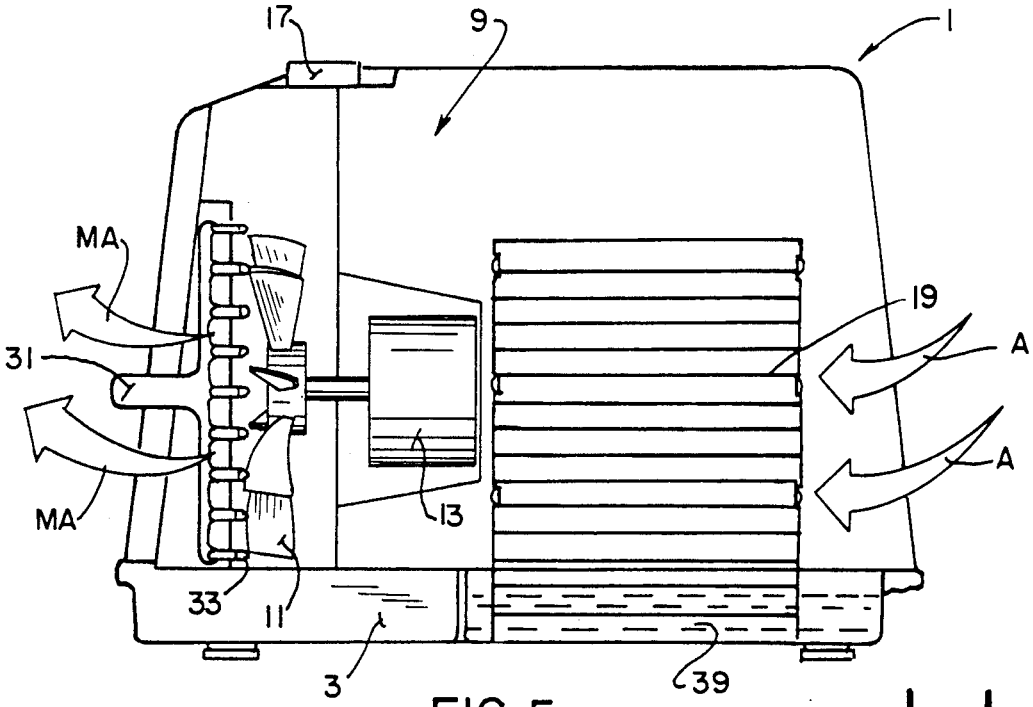
FIG. 5 is a diagrammatic illustration of the operation of the portable table top humidifier which illustrates the manner in which air is drawn into the humidifier and discharged therefrom after passing through the water absorbed wicking element thereof.
Figure 13:
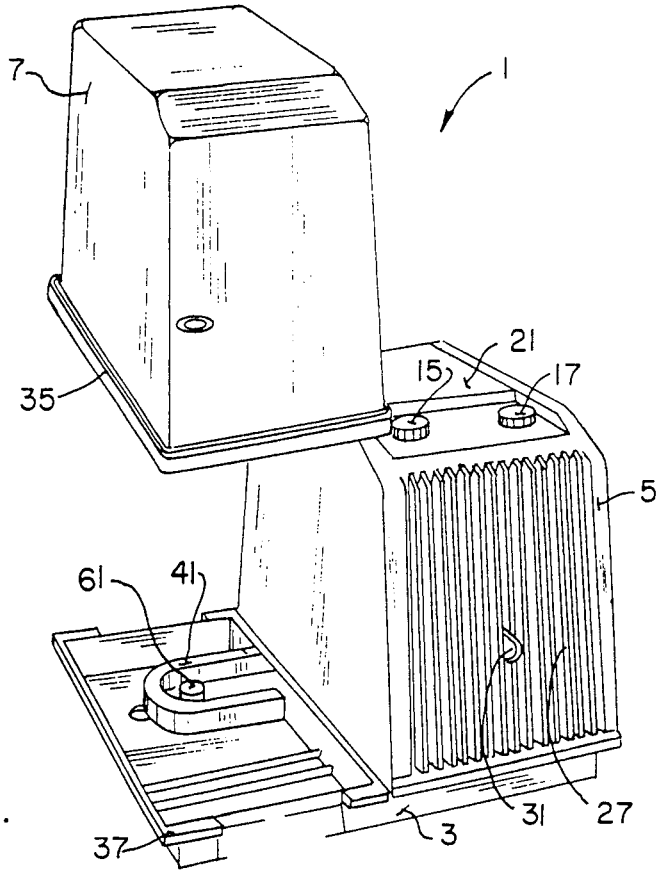
FIG. 13 is a perspective view of the portable table top humidifier with the water reservoir tank positioned upwardly from the supporting base thereof to expose the construction of the U-shaped channel underlying the water reservoir tank.
Figure 16:
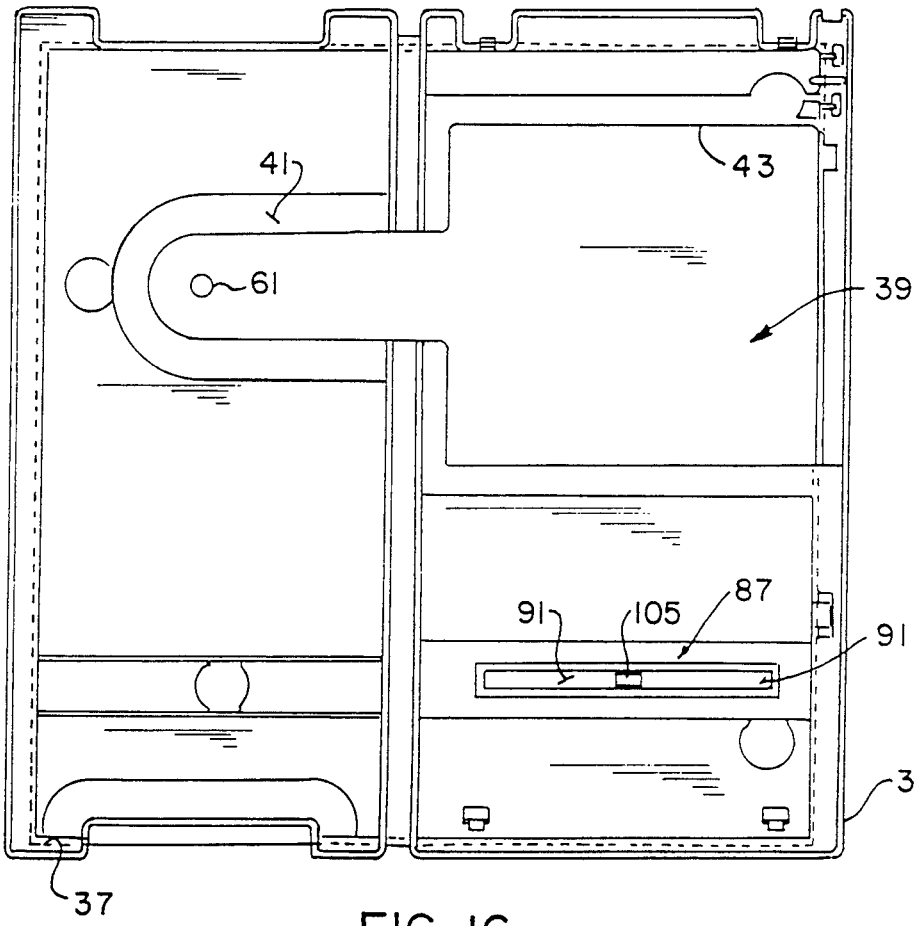
FIG. 16 is a top plan view of the supporting base of the portable table top humidifier, with the water reservoir tank, wicking element, motor assembly and housing removed therefrom.

When mounted on the supporting base 3 within the complementary configured flange 37 of the supporting base 3, the water reservoir tank 7 is constructed to dispense water as needed into a catch basin 39 formed in the supporting base. The catch basin 39 as best seen in FIGS. 5, 13 and 16, includes a U-shaped channel 41 immediately below the water reservoir tank 7 which opens up into an enlarged receptacle 43 below the wick element 19 containing water and for receiving the lower end of the wick element 19 therewithin. As best seen in FIG. 16, the shape of the enlarged receptacle 43 of the catch basin 39 is generally rectangular in shape to conform to the wick element or filter 19 for receiving the lower end of same therein.

Figure 9:
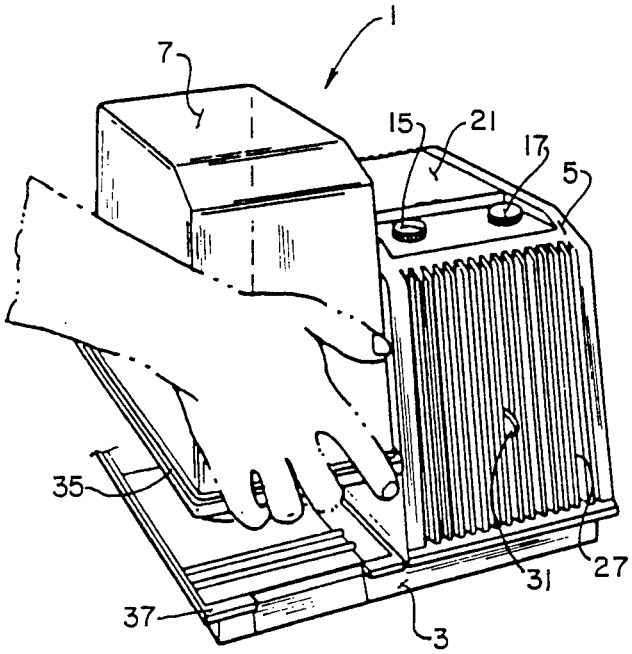
FIG. 9 is a perspective view of the portable table top humidifier and illustrating the manner in which the water reservoir tank is removably mounted relative to the humidifier.

To fill the water reservoir tank 7 with water, reference is made to FIGS. 9–12 of the drawings. In FIG. 9, the water reservoir tank 7 is shown as being moved from the supporting base 3 of the portable table top humidifier 1 by grasping the lower rim 35 of the water reservoir tank 7 and lifting upward. In this connection, it will be seen that the outer flange 37 is interrupted along the front and rear face of the supporting base 3, as best seen in FIGS. 9, 13 and 16, in order to allow the user to grasp the lower rim 35 of the water reservoir tank 7 for lifting same.

Figure 10:
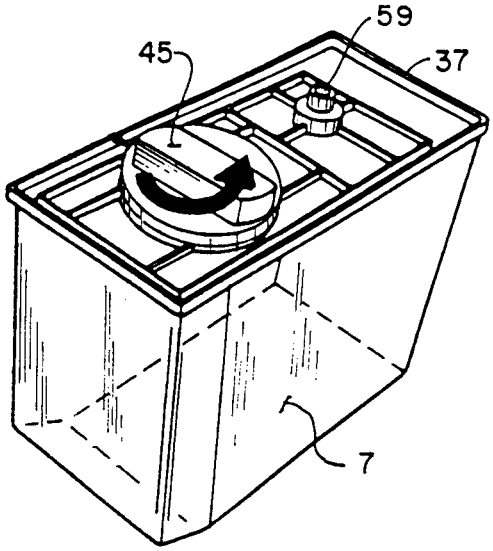
FIG. 10 is perspective view of the bottom of the water reservoir tank and illustrating the manner in which the removable fill cap is removed for filling the tank.
Figure 11:
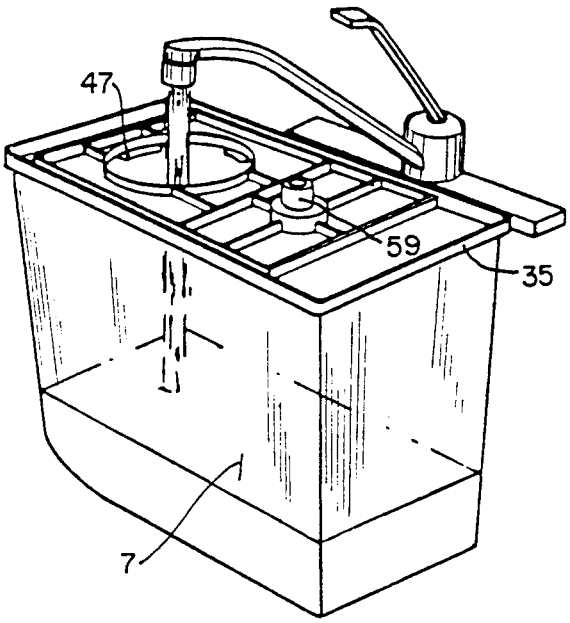
FIG. 11 is a bottom perspective view of the water reservoir tank illustrating filling thereof after removal of the removable fill cap.
Figure 12:
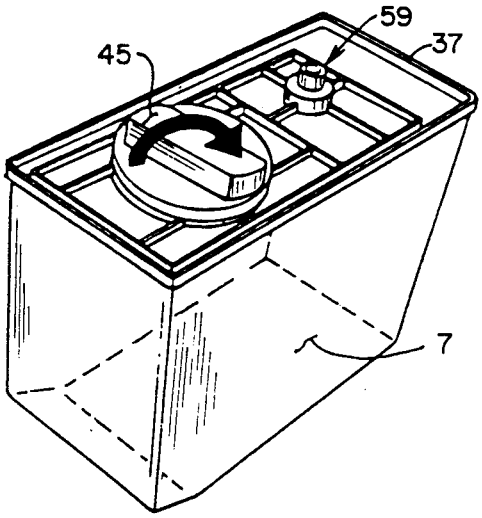
FIG. 12 is bottom perspective view of the water reservoir tank illustrating the manner in which the removable fill cap is rotated into locking/sealing engagement relative to the water reservoir tank.

Once removed from the supporting base 3, the water reservoir tank 7 is inverted to expose the removable fill cap 45 as seen in FIG. 10. By twisting the removable fill cap 45 in a counter clockwise direction, as shown by the arrow in FIG. 10, the center fill hole 47 in the bottom of the water reservoir tank 7 is exposed, as shown in FIG. 11, to allow the water hole 47 to be placed under a water faucet for filling the water reservoir 7. Following filling, the removable fill cap 45 is re-installed and is hand tightened by twisting the removable fill cap in a clockwise direction, as shown by the arrow in FIG. 12 of the drawings.

Figure 15:
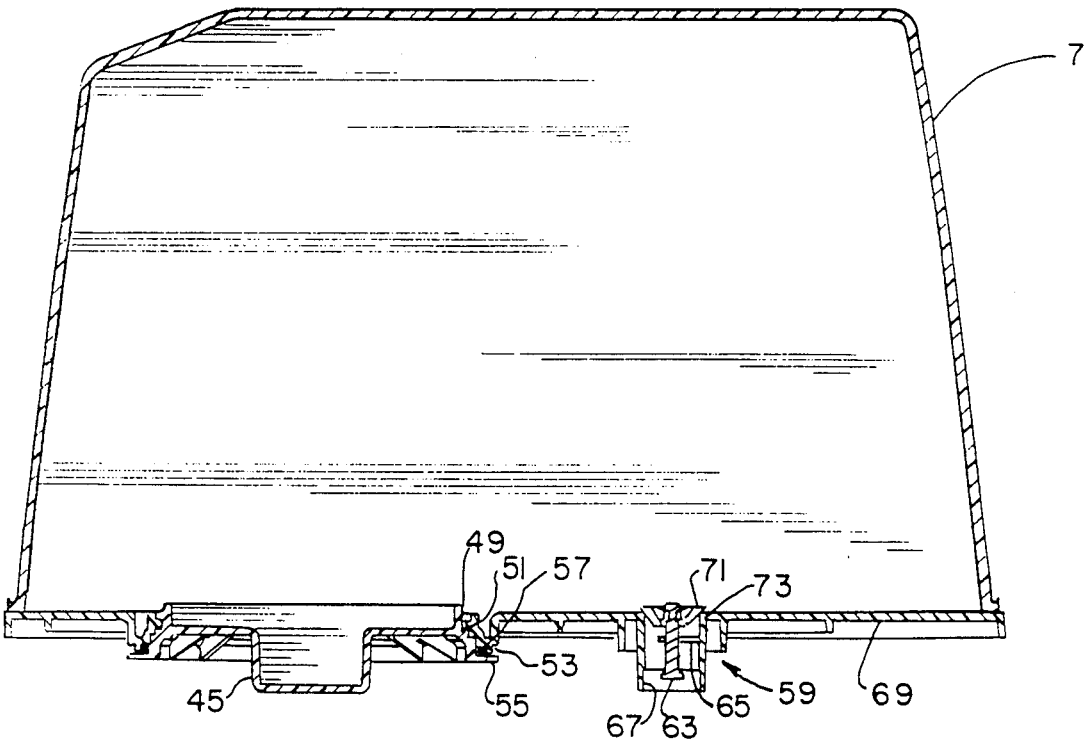
FIG. 15 is a side elevational sectional view of the water reservoir tank illustrating the manner in which the removable fill cap is threadably locked and sealed to the bottom of the water reservoir tank and including the spring biased valve stem with included valve seat for dispensing water from the water reservoir tank.

In FIG. 15 of the drawings, the removable fill cap 45 is shown as being provided with external threads 49 for complementary mating engagement with internal threads 51 surrounding the water hole 47. Also, an 0-ring or seal 53 is provided immediately beneath and overhanging lip 55 of the removable fill cap 45, such that when hand tightened in a clockwise direction, the 0-ring or seal 53 is trapped between the overhanging lip 55 of the removable fill cap 45 and horizontal shoulder 57 formed in the water reservoir tank 7 surrounding the center hole 47. Thus, leaking of water from the water reservoir tank 7 is prevented.

In order to dispense water as needed into the catch basin 39 formed in the supporting base 3, the water reservoir tank 7 is provided with valve means 59, as best seen in FIG. 15, which is selectively responsive to the level of water within the catch basin 39 for dispensing water from the water reservoir tank 7 into the catch basin 39 when the water in the catch basin 39 is below a predetermined level. For this purpose, the valve means 59 of the water reservoir tank 7 is mounted on a lower end thereof for engaging a valve activator 61 in the form of a fixed button activator that is located within the U-shaped channel 41 of the catch basin 39, to dispense water from the water reservoir tank 7.

The valve means 59 of the water reservoir tank 7 includes a spring biased valve stem 63 which is mounted on the shelf 65 within the tubular extension 67 that extends downwardly from end wall 69 and opens up into the water reservoir tank 7. The spring biased valve stem 63 includes valve seat/seal 71 which is mounted at the upper end thereof for engaging the upper innermost portion 73 of the tubular extension 67, that opens up into the water reservoir tank 7. The spring biased valve stem 63 is constructed to normally bias the valve seal/seat 71 into contact with the upper innermost inside wall portion 73 of the tubular extension 67, in order to prevent any water from being discharged through the tubular extension 67. However, when the water reservoir tank 7 is mounted within the outer flange 37 of the supporting base 3, the spring biased valve stem 63 is positioned to engage the fixed button valve activator 61 within the U-shaped channel 41 of the catch basin 39, with the tubular extension 67 surrounding the button activator 61, to allow air to bleed into the water reservoir tank 7 for discharging water therefrom through the tubular extension 67. Water from the water reservoir tank 7 is discharged or emptied into the catch basin 39, first through the U-shaped channel section 41 and then into the enlarged receptacle 43 thereof, until the water in the catch basin 39 reaches a predetermined level, which will then cut off air flow to the water reservoir tank. This occurs because the water level in the catch basin 39 surrounds and extends up into the tubular extension 67, so as to prevent any air from entering the water reservoir tank. When this occurs, water discharged from the water reservoir tank 7 will be stopped, until the water level in the catch basin 39 falls below the predetermined level in the catch basin 39. In actuality, when the water level extends up into the tubular extension 67 to prevent the entry of air, a vacuum is created between the top of the water in the reservoir and the inside top surface of the water reservoir tank 7 as to stop the flow of water, until air again enters the water reservoir tank 7, so as to allow water to be discharged through the tubular extension 67.

The wick element or filter 19 is preferably constructed in a suitable sheet-like absorbent and capillary wick material, as described in detail in aforementioned U.S. Pat. No. 4,822,533. As disclosed in that patent, the unitary web of non-woven, fibrous and absorbent wicking media maintain its shape and physical properties when in contact with water for extended periods of time. This material has been selected because it has sufficient absorption capacity as well as sufficient capillary action such that with only the bottom of the wicking element or filter 19 submerged below the predetermined level of water within the catch basin 39, the wick element or filter 19 will absorb water and will wick the water vertically by capillary action along the entire height of the wicking element or filter 19 so that same is substantially uniformally wetted throughout. Typically, the wick element or filter 19 begins to soak up the water immediately and becomes totally saturated in a short period of time, approximately thirty minutes.

At this point, the humidifier 1 can be operated to draw air into the rear of the humidifier through the air flow openings 23 by means of the fan motor assembly 9, allowing air to pass through the wicking element or filter 19 so that moisture is absorbed into the air and then released through the air discharge openings 29 in the front of the humidifier 1. Because all evaporation into the air takes place in the humidifier, moist air is released in the form of vapor, with no water droplets entering the home. Furthermore, any residue left by the evaporating water is not passed into the home, but remains in the wicking element or filter 19. As discussed above, the wicking element or filter 19 should be replaced, preferably once a season or more often under hard water conditions.

Figure 1:
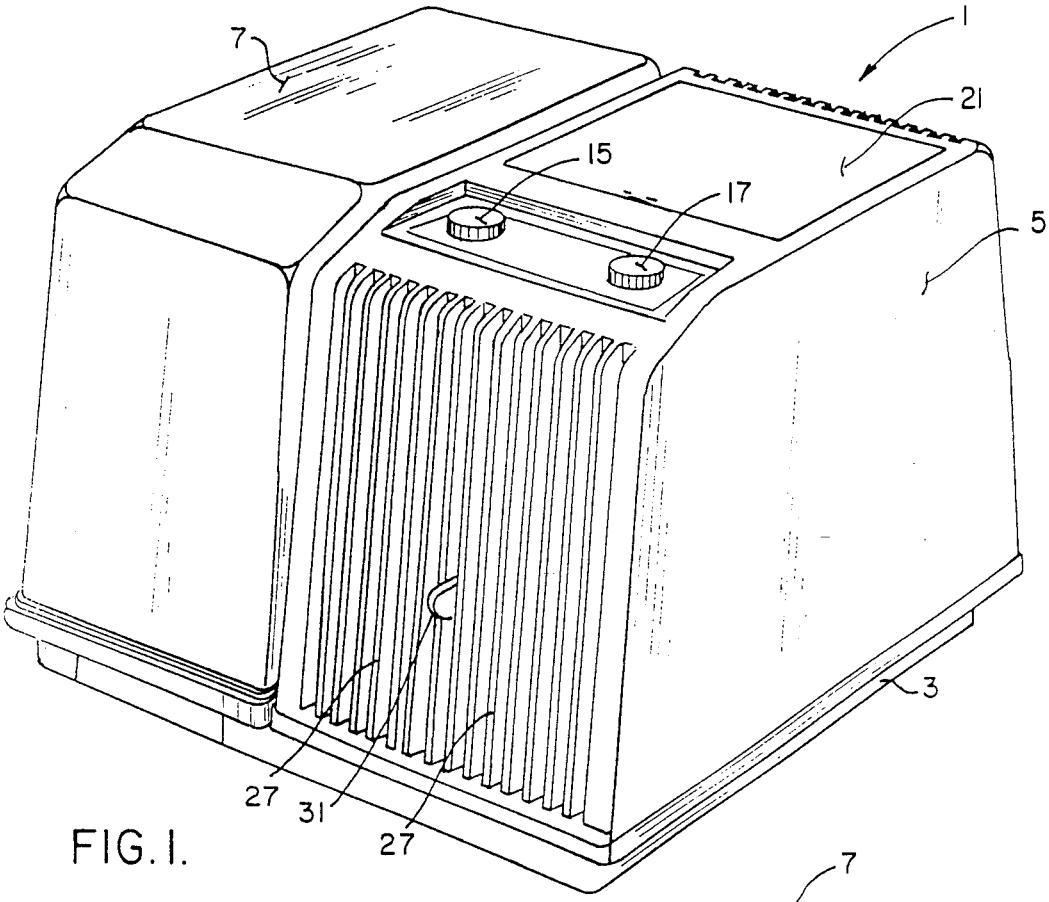
FIG. 1 is a perspective view of the portable table top humidifier constructed in accordance with the teachings of the present invention.
Figure 2:
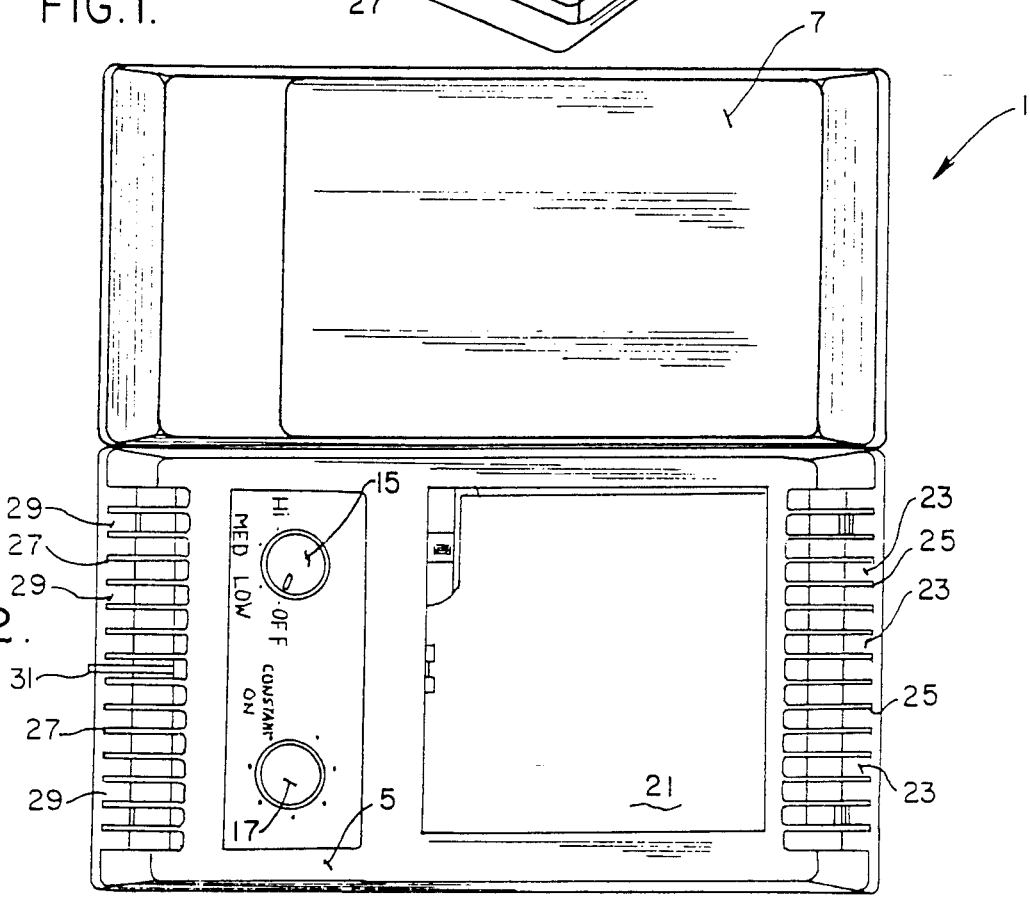
FIG. 2 is a top plan view of the portable table top humidifier shown in FIG. 1.
Figure 3:
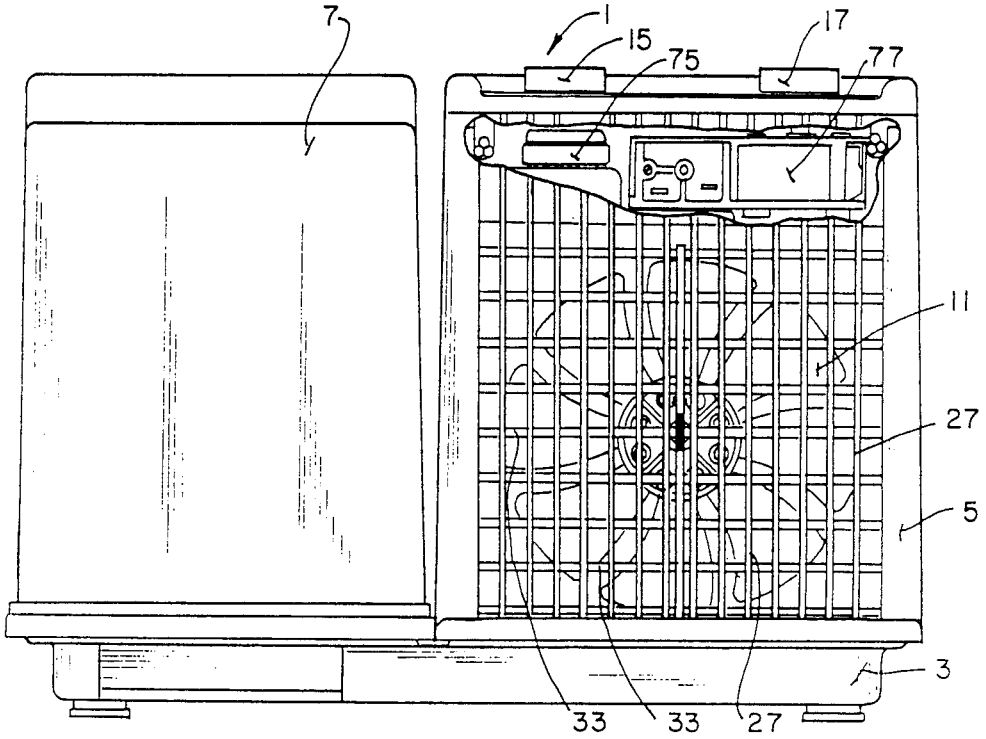
FIG. 3 is a front end view of the portable table top humidifier, with a partial fragmentary section revealing electronic components used in the motor control circuit of the humidifier.

Reference is now made to FIGS. 1–6 for the description of the air flow and humidity operating controls 15, 17. For energizing the fan motor assembly 9, the air flow control 15 is rotated from an off to a low or medium or high operation to cause the motor 13 to drive the fan 11 to low, medium or high flow output. As shown in FIG. 3 of the drawings, the air flow control 15 is connected to the switch 25 positioned therebelow, (shown in the cut out area of FIG. 3), for energizing the motor 13 to operate in low or medium or high operation.

Figure 6:
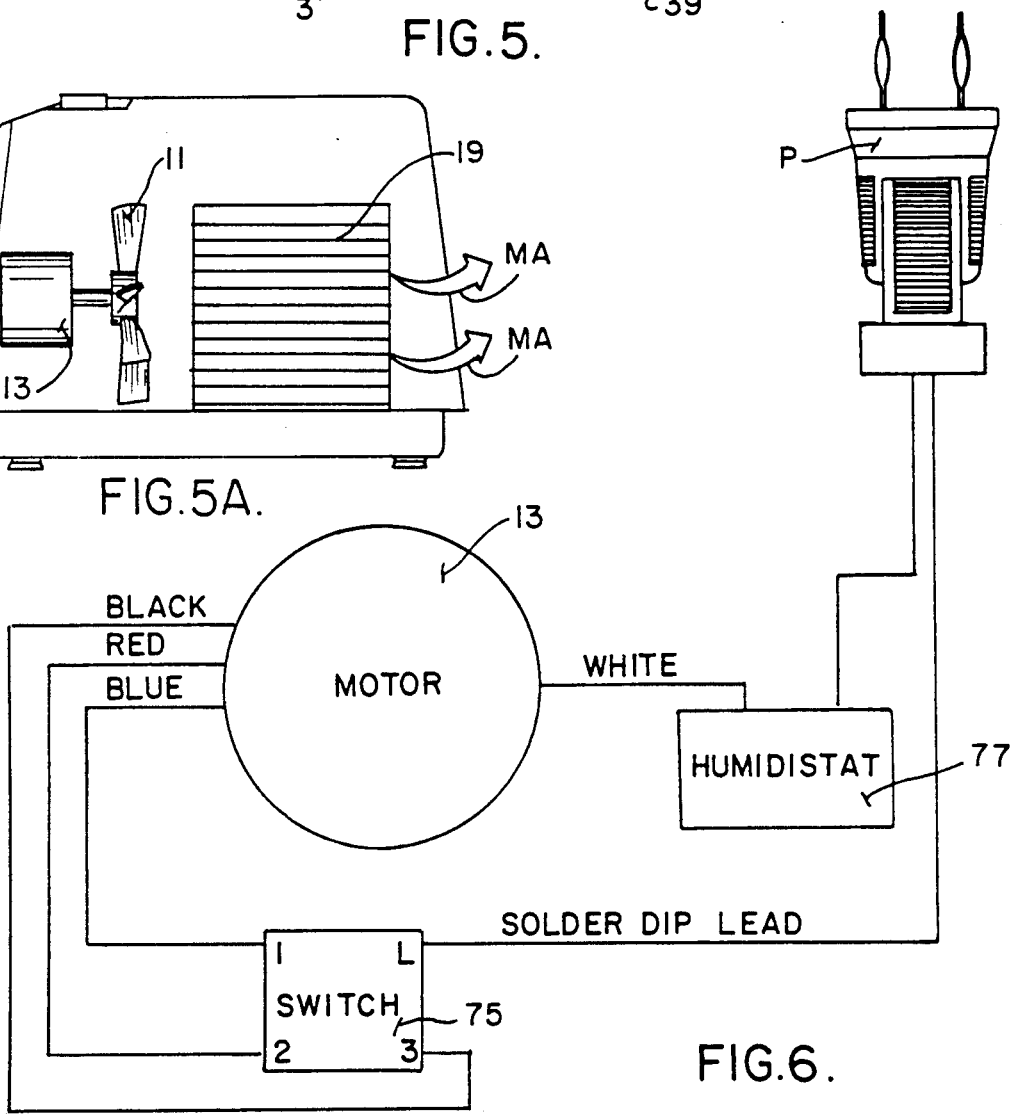
FIG. 6 is a diagrammatic view of the motor controlled circuit for the fan driven motor used in the humidifier.

The humidity control 17, when rotated to a "constant on" position, allows the maximum amount of humidity to be evaporated into the air continuously or rotated to a low or medium or high setting, where the humidifier will turn on and off to maintain the level of humidity selected. For this purpose, the humidity control 17 is connected to the humidistat 77 also shown in the cut out portion of FIG. 3. The humidistat 77 is electrically interconnected in the control circuit, as shown in FIG. 6 of the drawing, where 77 will turn the motor 13 on and off as required to maintain the level of humidity selected. The motor control circuit of FIG. 6 further includes the rotary switch 75 and wall plug P which is connected to the cord C extending to the humidifier (See FIG. 4) For constant operation of the humidifier 1, the setting is allowed for constant on in order to provide a maximum amount of humidity to be evaporated into the air continuously.

Operation of the portable table top humidifier 1 shown in FIGS. 1–13 of the drawings can best be understood by referring to FIG. 5 and the description that follows Once the air flow and humidity control buttons 15, 17 have been pre-set as described above, the humidifier 1 will turn on and off as required to maintain the level of humidity selected or will operate continuously, by the humidity control 17 being pre-set in a "constant on" position. Dry heated air, as represented by the arrows A in FIG. 5, will be drawn into the humidifier 1 by the fan motor assembly 9, so as to pass through the wicking element or filter 19. As previously discussed, the wicking element or filter 19 will absorb and allow sufficient water to flow up into the wicking element or filter 19 from the water in the catch basin 39, as a result of the lower end of the wicking element or filter 19 being positioned within catch basin 39. Water is absorbed up into the wick element or filter 19 by capillary action, as discussed above. The fan 11 will draw dry heated air A, through the air inflow openings 23 in the rear of the humidifier, for contact with the wick element or filter 19. As air passes through the wick element or filter 19, moisture is absorbed into the air and then released through the air discharge openings 29 in the front of the humidifier 1 in the form of moist air, represented by the arrows MA, in FIG. 5. The moist air MA is released in the form of vapor, rather than water droplets, because all evaporation into the air takes place within the confines of the humidifier. This also means that any residue left by the evaporating water will not be passed into the home, but will remain in the wicking element or filter 19.

Figure 5A:
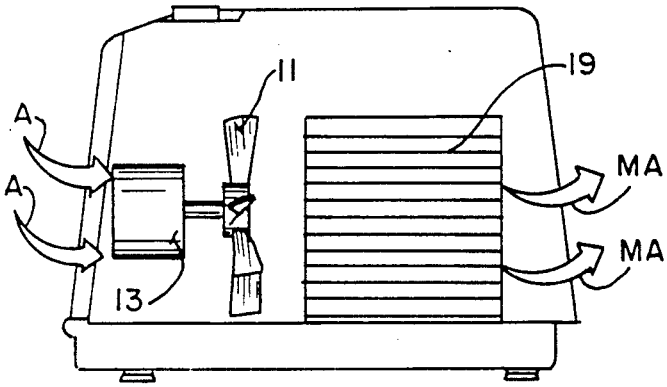
FIG. 5A is a diagrammatic illustration similar to FIG. 5, but showing the manner in which air is blown through the wick element by a different fan arrangement.

FIG. 5A shows how air can be blown, instead of drawn through the wicking element 19, by a different fan arrangement.

Due to the transparent construction of the water reservoir tank 7, the humidifier user can easily determine when the level of the water in the water reservoir tank 7 is low or depleted. As discussed in detail above, the water reservoir tank 7 can then be removed from the supporting base 3, to allow the water reservoir tank to be filled as has been previously shown and described in connection with FIGS. 9--12 of the drawings.

The valve means 59 in the water reservoir tank 7, which is in the form of the spring biased valve stem 63 with included valve seat/seal 71, is constructed to engage the fixed button activator 61 within the U-shaped channel 41 of the catch basin 39, with the tubular extension 67 extending thereover. When the spring biased valve stem 63 is engaged by the fixed button activator 61 within the U-shaped channel 41 of the catch basin 39, the valve seat/seal 71 will be disengaged on the upper innermost inner wall area 73 of the tubular extension 67 to allow air to bleed into the water reservoir tank for discharging water therefrom. This will continue until the water level in the catch basin 39 reaches a predetermined level, at which point, the water level in the catch basin 39 will cut-off air flow into the water reservoir tank 7 to stop water discharged therefrom. The humidifier will run continuously until the air flow control 15 is turned off. Letting the humidifier 1 run until after the water reservoir tank 7 is empty will thoroughly dry the wicking element or filter 19 out. This will make it necessary to allow suffcient time for capillary action to wet the entire wicking element or filter 19, for subsequent efficient operation of the humidifier.

Figure 14:
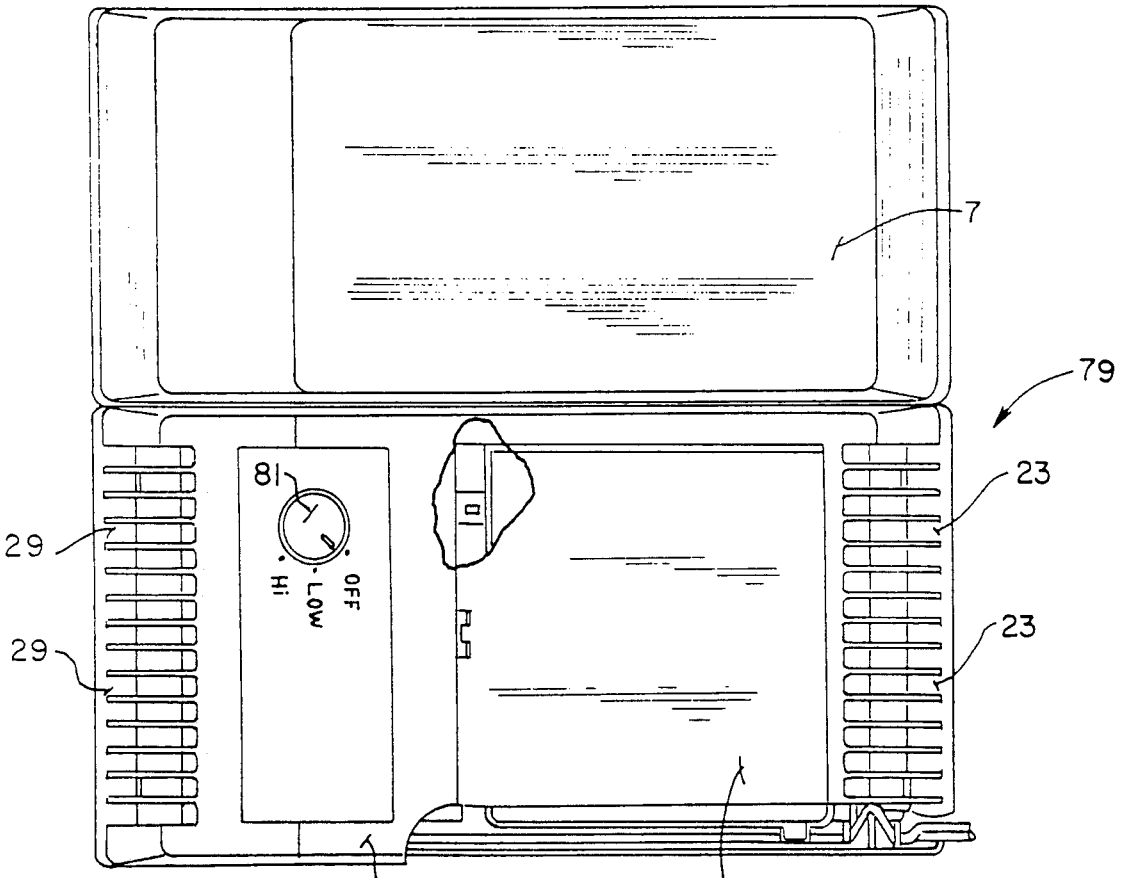
FIG. 14 is a top plan view of a modified form of portable table top humidifier which utilizes only a single control for operating same.

A modified form of portable table top humidifier is shown in FIG. 14 of the drawings. Similar reference numerals will be used to designate like parts in the FIGS. 1–13 embodiment. The humidifier 79 differs from the humidifier 1 in the FIGS. 1–13 embodiment in that there is only an air flow control 81, rather than air flow and humidity controls 15, 17, as in the FIGS. 1-13 embodiment. Thus, FIG. 14 contains no humidity control whatsoever, and is operated solely by the air flow control 81 which has a normal off as well as a low and high position. This more economical model also has a more simplified motor control circuit (not shown) without the humidistat 77 as shown in FIG. 6 of the FIGS. 1–13 embodiment. Nonetheless, the humidifier 79 will generally operate by converting dry air to moist air, along the lines of that described in connection with FIG. 5 of the drawings.

Figure 17:
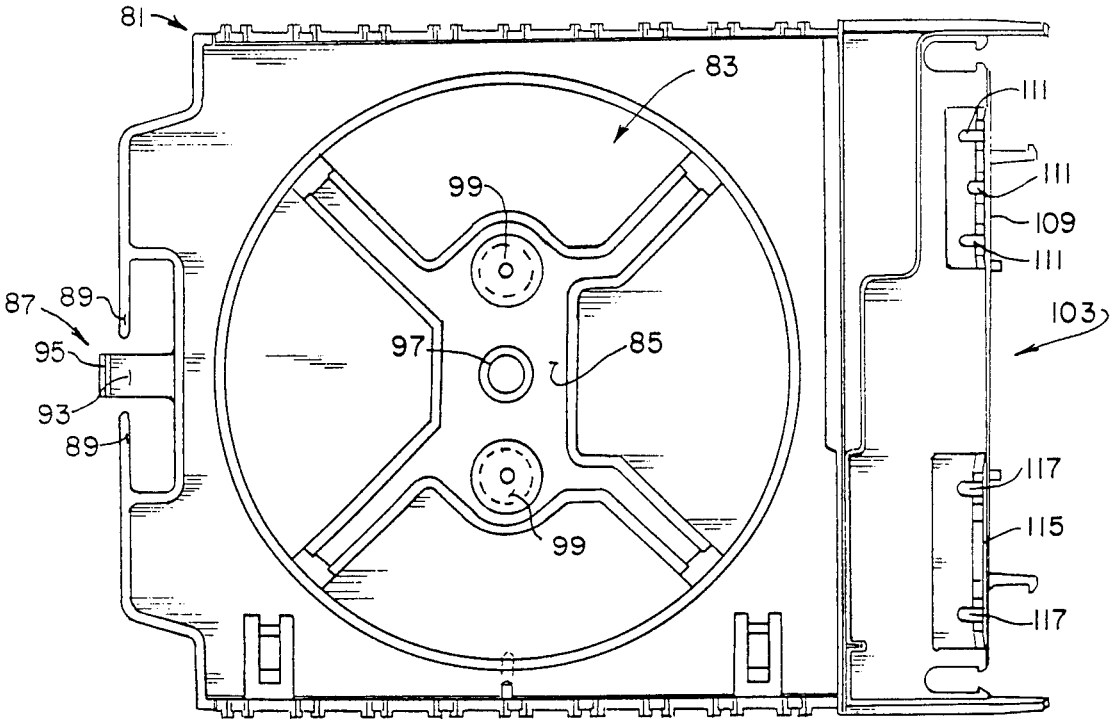
FIG. 17 is an end elevational view of a one-piece injection molded motor frame including quick interconnect locking means for assembly of the motor frame to the supporting base.
Figure 18:
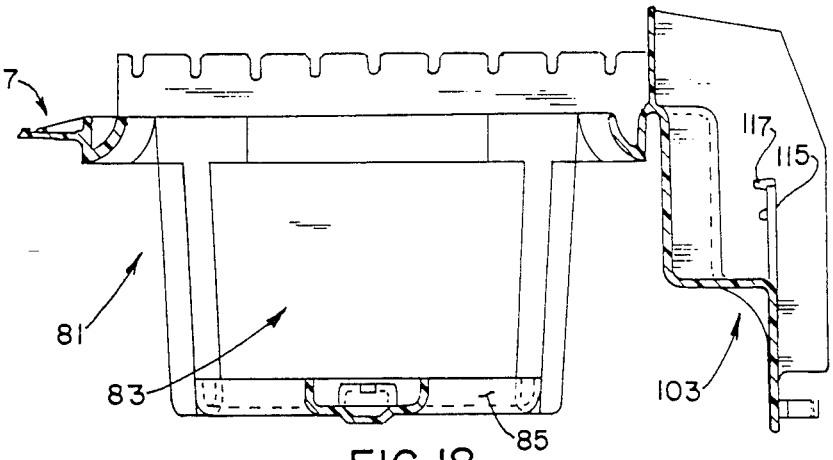
FIG. 18 is a side elevational view of the one-piece injection molded motor frame illustrated in FIG. 17.

Reference is now made to FIGS. 16–20 in the drawings for the unique way in which the fan motor assembly is supported and mounted relative to the supporting base 3 in the portable table top humidifier 1 of the present invention. In FIGS. 17–18 of the drawings, there is shown a one-piece injection molded plastic motor frame 81 with a motor supporting section 83 including the web section 85 at the rear of the motor support section 83, in order to hold the motor 13 therein.

For assembly of the one-piece injection molded plastic motor frame 81 to the supporting base 3, the motor frame includes first quick interconnect locking means 87 provided on the motor frame 81 as well as the supporting base 3. Specifically, the motor frame includes, at the lower end thereof, a pair of spaced supporting feet 89, 89 for complementary reception within the elongated slot 91, provided in supporting base 3. It will be noted that each of the spaced supporting feet 89, 89 are positioned on opposite sides of a generally centrally positioned interlocking element 93 which is adapted to be interlocked within centrally positioned opening 105 provided in the elongated slot 91 of the supporting base 3. The lower end of the centrally positioned interlocking element 93 are formed with locking teeth or steps 95 for interfitting and interlocking relationship within the opening 105 of the elongated slot. When the quick interconnecting locking means 87, including the spaced supporting feet 89, 89 and the centrally positioned interlocking element 93 are received within the elongated slot 91 and center opening 105, respectively, the one-piece injection molded plastic motor frame 81 will be structurally and stably secured relative to the supporting base 3, in order to allow the motor 13 to be received within the motor supporting section 83.

It will be noted that the web elements 85 at the rear of the motor support section 83 include an opening 97 and spaced bosses 99, 99, to facilitate mounting the motor 13 within the motor support section 83, through various fastening elements 101, as generally shown in FIG. 4 of the drawings.

Figure 20:
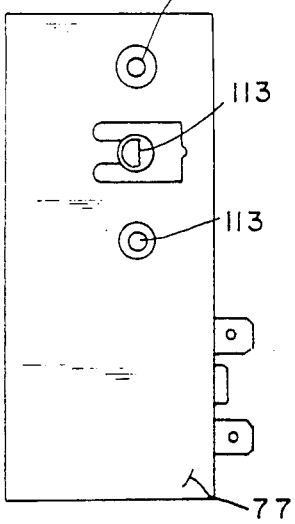
FIG. 20 is a top plan view of a humidistat with complementary openings therein for receiving integral fastener studs from an overlying flexible panel in the second quick interconnect locking means associated with the motor frame for assembly of the humidistat thereto.
Figure 19:
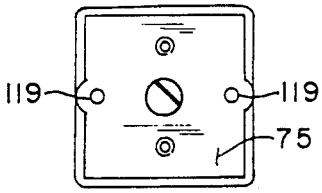
FIG. 19 is a top plan view of a rotary switch with complementary openings therein for receiving integral fastener studs from an overlying flexible panel in the second quick interconnect locking means associated with the motor frame.

The one-piece injection molded plastic motor frame 81 further includes second quick interconnect locking means 103 for quick assembly of a rotary switch 75 shown in FIG. 19 and a humidistat 77 shown in FIG. 20 to the motor frame 81. For this purpose, the second quick interconnecting means 103 includes an overlying flexible panel 109 having three integral studs 111 depending therefrom for complementary register with three holes 113 in the humidistat 77, along with an overlying flexible panel 115 and a pair of integral fastener studs 117, 117 depending therefrom for complementary register with the holes 119, 119 in the rotary switch 75. As shown in FIG. 17 the overlying flexible panels 109 and 115 may be interconnected together by a common wall 121, if desired. Thus, as can be seen, the rotary switch 75 and humidistat 77 may be quickly and easily installed relative to the motor frame 81 through the aforementioned quick interconnect means 103, to permit stable and secure retention of same relative to the motor frame 81. Reference to FIG. 3 of the drawings shows the manner in which the rotary switch and humidistat 75, 77 respectively are mounted in position in the motor frame 81 within the portable table top humidifier 1.

While the fan assembly 9 is preferably located relative to the wick element 19 as shown in the drawings, it will also be appreciated that the fan assembly may be positioned to blow rather than draw air through the wick element 19. In broader terms, therefore, the fan assembly 9 is mounted relative to the wick element for directing (including drawing and/or blowing) air with increased humidity through the wick element for discharge from the humidifier into the surrounding atmosphere.

With respect to the location of the air inflow and air discharge openings in the housing 5, the preferred construction is as shown in the drawings. However, it will also be understood that the air inflow openings may be located on a face of the housing 5 other than the rear face thereof and the air discharge openings may also be located on a face of the housing 5 other than the front face thereof.

Various other changes or modifications can be made in the portable table top humidifier 1 of the present invention, such as being in keeping with the written and illustrated disclosures of this invention.

From the foregoing, it will be seen that the several objects and features of the invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

We claim:

1. A humidifier including:

a supporting base;

at least one water reservoir tank, at least one wick element and a motor driven fan each mounted relative to said supporting base and positioned in adjacent relationship to each other in said humidifier;

each said water reservoir tank having a predetermined width, depth and height dimension, each said wick element and said motor driven fan being located within the dimensional confines of planes extending through end surfaces at each end of the predetermined height and depth dimensions of each said water reservoir tank;

each said water reservoir tank being enclosed, refillable and removably positioned relative to said supporting base to facilitate refilling thereof, each said water reservoir tank also being constructed to dispense water into a catch basin associated with said supporting base;

said catch basin including a channel portion located beneath each said reservoir tank and extending laterally therefrom to an adjacent catch basin area;

each said wick element being mounted in fixed position in said humidifier during operation and being removable from said humidifier for replacement or cleaning, each said wick element also having a lower end positioned in said adjacent catch basin area for absorbing water up into the wick element by capillary action;

means for providing predetermined constant humidification of air, said last mentioned means including means associated with each water reservoir tank for maintaining a predetermined constant water depth in said catch basin above the lower end of each said wick element for constant wetting thereof; and said motor driven fan positioned relative to each said wick element for directing air with increased humidity through each said wick element for discharge from the humidifier into the surrounding atmosphere;

2. The humidifier as defined in claim 1 wherein each said wick element and fan blades associated with said motor driven fan extend transversely relative to each said water reservoir tank.

3. The humidifier as defined in claim 1 wherein said motor driven fan is positioned relative to each said wick element to draw air through each said wick element.

4. The humidifier as defined in claim 1 wherein said motor driven fan is positioned relative to each said wick element to blow air through each said wick element.

5. The humidifier as defined in claim 1 wherein said catch basin including said adjacent catch basin area being substantially enclosed against exposure to air during operation of said humidifier.

6. The humidifier as defined in claim 5 wherein each said wick element, said motor driven fan and at least said adjacent catch basin area are contained within a housing mounted relative to said supporting base.

7. The humidifier as defined in claim 6 wherein each said water reservoir tank is mounted relative to said supporting

8. The humidifier as defined in claim 1 and including valve means selectively responsive to the level of water within the catch basin for dispensing water from the water reservoir tank into said catch basin when the water in the catch basin is below a predetermined level.

9. The humidifier as defined in claim 8 wherein the valve means of the water reservoir tank is mounted on a lower end thereof for engaging a valve activator within the catch basin to dispense water from the water reservoir tank.

10. The humidifier as defined in claim 9 wherein the lower end of the reservoir tank also includes a removable fill cap to permit filling of the reservoir tank with water, when removed from the supporting base.

11. The humidifier as defined in claim 10 including a housing containing each said wick element and said motor driven fan, air inflow openings provided in said housing along a first face thereof and air discharge openings provided on a second face of said housing.

12. The humidifier as defined in claim 11 wherein the first face of said housing comprises a rear housing face and the second face of said housing comprises a front housing face.

13. The humidifier as defined in claim 12 wherein said housing includes a hinged cover along an upper face thereof and above said wick element to enable removal and replacement of said wick element, as desired.

14. The humidifier as defined in claim 13 wherein the catch basin channel portion includes a U-shaped channel below said water reservoir tank which opens up into an enlarged receptacle below said wick element for containing water and for receiving the lower end of the wick element therewithin.

15. A humidifier including:

a supporting base;

at least one water reservoir tank, at least one wick element and motor driven fan means each mounted relative to said supporting base and positioned in adjacent relationship to each other in said humidifier;

each said water reservoir tank having av predetermined width, depth and height dimension, at least one wick element and fan blades associated with said motor driven fan extending transversely relative to each said reservoir tank, each said wick element and said motor driven fan being located within the dimensional confines of planes extending through end surfaces at each end of the predetermined height and depth dimensions of each said water reservoir tank;

each said water reservoir tank being enclosed, refillable and removably positioned relative to said supporting base to facilitate refilling thereof, each said water reservoir tank also being constructed to dispense water into a catch basin associated with said supporting base;

said catch basin including a channel portion located beneath each said reservoir tank and extending laterally therefrom to an adjacent catch basin area, said catch basin including said adjacent catch basin area being substantially enclosed against exposure to air during operation of said humidifier;

a housing mounted relative to said supporting base for containing each said wick element, said motor driven fan and at least said adjacent catch basin area, said housing including air inflow openings provided along a first face and air discharge openings provided along a second face;

each said wick element being mounted in fixed position in said humidifier during operation and being removable from said humidifier for replacement or cleansing, each said wick element also having a lower end positioned in said adjacent catch basin area for absorbing water up into the wick element by capillary action;

means for providing predetermined constant humidification of air, said last mentioned means including means associated with each water reservoir tank for maintaining a predetermined constant water depth in said catch basin above the lower end of each said wick element for constant wetting thereof; and said motor driven fan positioned relative to each said wick element for directing air through said air flow openings for movement through each said wick element and for discharge from the humidifier with increased humidity through said air discharge openings into the surrounding atmosphere;

the relationship of each said wick element and motor driven fan to each said water reservoir tank providing a compact and efficient humidifier.

16. The humidifier as defined in claim 15 wherein each said wick element along with the fan blades associated with said motor driven fan extend transversely relative to each said water reservoir tank.

17. In a humidifier including a supporting base, the improvement comprising: at least one water reservoir tank, at least one wick element and motor driven fan means each mounted relative to said supporting base and positioned in adjacent relationship to each other in said humidifier, each said water reservoir tank having a predetermined width, depth and height dimension, each said wick element and said motor driven fan being located within the dimensional confines of planes extending through and surfaces at each end of the predetermined height and depth dimensions of each said water reservoir tank, each said water reservoir tank being enclosed, refillable and removably positioned relative to said supporting base to facilitate refilling thereof, each said water reservoir tank also being constructed to dispense water into a catch basin associated with said supporting base, said catch basin including a channel portion located beneath each said reservoir tank and extending laterally therefrom to an adjacent catch basin area, each said wick element being mounted in fixed position in said humidifier during operation and being removable from said humidifier for replacement or cleaning, each said wick element also having a lower end positioned in said adjacent catch basin area for absorbing water up into the wick element by capillary action, means for providing predetermined constant humidification of air, said last mentioned means including means associated with each water reservoir tank for maintaining a predetermined constant water depth in said catch basing above the lower end of each said wick element for constant wetting thereof, and said motor driven fan positioned relative to each said wick element for direction air with increased humidity through each said wick element for discharge from the humidifier into the surrounding atmosphere, the relationship of each said wick element and motor driven fan to each said water reservoir tank providing a compact and efficient humidifier.

18. A humidifier including:

a rectangularly shaped supporting base having spaced ends connected to spaced longer sides;

at least one enclosed and refillable water reservoir tank removably mounted to said supporting base along one end and extending a predetermined distance along both spaced longer sides of said supporting base;

a housing mounted to said supporting base and being configured and dimensioned to fill the remainder of the supporting base which remains unoccupied by each said water reservoir tank;

at least one stationary wick element and a motor driven fan contained within said housing for directing air through said at least one wick element and for discharging air with increased humidity into the surrounding atmosphere, each said wick element also being removable from said housing for replacement or cleaning;

each said water reservoir tank having a predetermined width, depth and height dimension, said housing including each said wick element and said motor driven fan being located within the dimensional confines of planes extending through end surfaces at each end of the predetermined height and depth dimensions of each said water reservoir tank;

a catch basin of predetermined depth associated with said supporting base and including a channel portion for receiving water from said at least one water reservoir tank and for transporting water to said at least open wick element, said at least one wick element having its lower end positioned within the catch basin below the water for absorbing water up into the at least one wick element by capillary action;

means for providing predetermined constant humidification of air, said last mentioned means including means for maintaining a predetermined constant water depth in said catch basin for constant wetting of the lower end of said at least one wick element in order to permit air with increased humidity to be directed by said fan through said water absorbed at least one wick element for discharge into the surrounding atmosphere; and said motor driven fan positioned relative to each said wick element for directing air with increased humidity through each said wick element for discharge from the humidifier into the surrounding atmosphere;

the relationship of each said wick element and motor driven fan to each said water reservoir tank providing a compact and efficient humidifier.

19. In a table top humidifier including a supporting base, the improvement comprising: at least one water reservoir tank for receiving a supply of water and being mounted relative to said supporting base, a housing also mounted relative to said supporting base and including a wick element and motor driven fan for directing air through said wick element and for discharging air with increased humidity into the surrounding atmosphere, a one-piece injection molded motor frame having first quick interconnect locking means for assembly of said motor frame to said supporting section for supporting said motor and second quick interconnect locking means for assembly of a rotary switch and humidistat to said motor frame.

20. The improvement as defined in claim 22 wherein the first quick interconnect locking means includes an elongated slot formed in said supporting base with a generally centrally positioned interlocking slot therein, said motor frame including complementary configured spaced supporting feet for receipt within the elongated slot on opposite sides of said interlocking slot in order to support the motor frame relative to said supporting base, said motor frame further including a complementary interlocking element for interlocking within said interlocking slot in order to provide assembly of said motor frame to said supporting base.

21. The improvement defined in claim 20 wherein the second quick interconnect means for assembly of the rotary switch and humidistat includes a rotary switch and a humidistat housing each having a overlying flexible panel having integral fastener studs depending therefrom for engagement within complementary openings formed in said switch and humidistat.

* * * * *